United States Patent [19]

Mowbray

[11] 4,406,264

[45] Sep. 27, 1983

[54] GOVERNOR FOR ENGINES

[75] Inventor: Dorian F. Mowbray, Burnham, England

[73] Assignee: Lucas Industries Limited, Birmingham, England

[21] Appl. No.: 280,123

[22] Filed: Jul. 2, 1981

[30] Foreign Application Priority Data

Jul. 26, 1980 [GB] United Kingdom ..... 8024539

[51] Int. Cl.[3] ..... F02D 7/00; F02D 1/12

[52] U.S. Cl. ..... 123/387; 123/460; 123/462; 417/462

[58] Field of Search ..... 123/387, 385, 460, 450, 123/462; 417/462, 221, 253

[56] References Cited

U.S. PATENT DOCUMENTS 3,485,225 12/1969 Bailey ..... 123/387
3,667,439 6/1972 Muir ..... 123/387
4,187,822 2/1980 Craven ..... 123/387
4,301,777 11/1982 Grundman ..... 123/387

*Primary Examiner*—Charles J. Myhre
*Assistant Examiner*—Carl Stuart Miller

[57] ABSTRACT

A two speed governor for a fuel pumping apparatus which supplies fuel to an internal combustion engine comprises a source of fuel under pressure which varies in accordance with the speed of the engine. Fuel is supplied through a first orifice and a second orifice in series from the source. The second orifice is defined by a port the size of which is controlled by a manually operable rod while the first orifice is defined by a port the size of which is controlled by a spool responsive to the pressure of the source. The port closes at the maximum allowed engine speed. A third orifice defined by a port is also controlled by the spool and is connected in parallel with the second orifice. The port is closed at speeds above the idling speed of the engine. In the intermediate speed range the engine is controlled by the rod.

7 Claims, 2 Drawing Figures

GOVERNOR FOR ENGINES

This invention relates to an hydraulic governor for use with a fuel injection pumping apparatus for supplying fuel to an internal combustion engine, the governor being of the so called "two-speed" type.

A "two-speed" governor as understood in the art of engine fuel control is a governor which controls the idling speed of the engine and also the maximum speed of the engine leaving the control of the engine between these two speeds in the hand of the operator of the engine.

The object of the invention is to provide such a governor in a simple and convenient form.

According to the invention a two-speed governor for use with a fuel injection pumping apparatus for supplying fuel to an internal combustion engine comprises, a source of fuel under pressure, means for controlling said pressure so that it varies in accordance with the speed at which in use the associated engine is driven, first and second variable orifices connected in series and through which fluid can flow from said source, manually operable means for controlling the degree of restriction offered by said second orifice, piston means responsive to the pressure of said source and acting to close said first orifice when the speed of the associated engine increases to its maximum value, and a third variable orifice connected in parallel with at least said second orifice, said piston means acting to close said third orifice when the speed of associated engine is above its idling speed, the fuel flow through said orifices acting to control the amount of fuel supplied by the apparatus.

Figure 1:
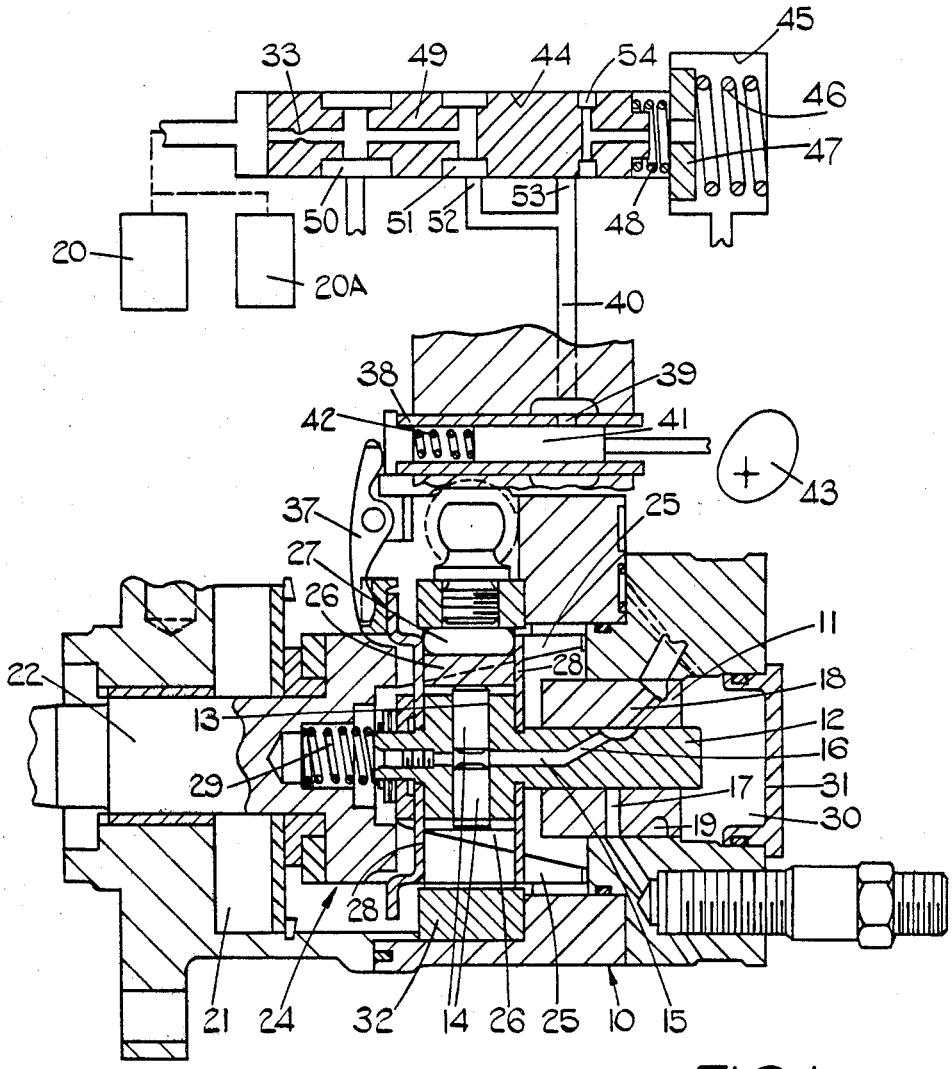
Figure 2:
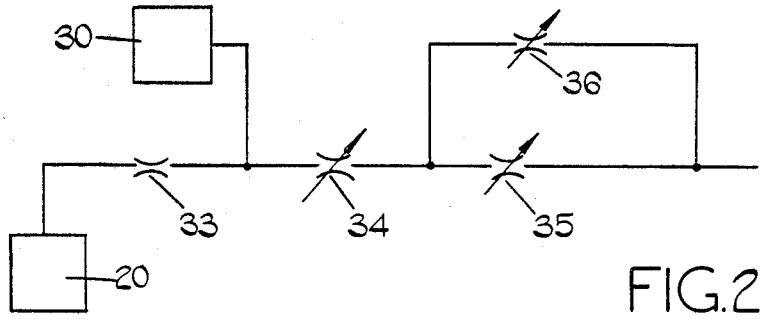

In the accompanying drawings:

FIG. 1 is a sectional side elevation of one example of an apparatus in accordance with the invention; and FIG. 2 is a fluid circuit diagram of the apparatus of FIG. 1.

Referring first to FIG. 1 of the drawings, the apparatus comprises a multi-part body 10 which includes a sleeve 11 in which is mounted a rotary cylindrical distributor member 12. The distributor member projects from the sleeve 11 and is provided with an outwardly extending transverse bore 13 in which is mounted a pair of reciprocable pumping plungers 14. The bore 13 communicates with an axial passage 15 formed in the distributor member and which connects with a delivery passage 16 terminating on the periphery of the distributor member, in an axial groove. The groove registers in turn and as the distributor member rotates with outlet ports 17 only one of which is shown, and which, in use, are connected to the injection nozzles respectively of the associated engine. The aforesaid groove can also register with inlet passages 18 which lie in the same radial plane as the outlet passages 17 and which communicate with a circumferential groove 19 which is formed in the peripheral surface of the sleeve 11 and which communicates with the outlet of a fuel supply pump which is housed in a space indicated at 21 but is shown at 20. The supply pump draws fuel from a fuel inlet not shown and its output pressure is controlled by a valve 20A so that it varies in accordance with the speed at which the apparatus is driven.

The rotary part of the supply pump is carried on a drive shaft 22 which is journalled in the body part and which in use is driven from the associated engine. The drive shaft includes an enlarged head portion 24 which surrounds the end of the distributor member which projects from the sleeve. The head portion defines a pair of slots 24 in which are located shoes 26 which at their inner ends engage the plungers 14 respectively and which at their outer ends are provided with grooves which carry rollers 27. In addition, located in the slots 25 are drive plates 28 which are connected to the distributor member. The drive plates transmit drive between the drive shaft 22 and the distributor member but at the same time allow axial movement of the distributor member.

The internal surface of the enlarged portion 24 of the shaft is flared outwardly and the shoes 26 are provided with complementary surfaces whereby the extent of outward movement of the plungers 14 will depend upon the axial setting of the distributor member. The drive shaft defines a chamber in which is located a coiled compression spring 29 which acts upon the adjacent end of the distributor member to urge it as shown in the drawing, towards the right. A chamber 30 is defined in part by the end surface of the distributor member and in part by a cover 31. A fluid seal is defined between the cover and the body part.

The rollers 27 engage the internal peripheral surface of an angularly adjustable cam ring 32. On the internal peripheral surface of the cam ring are formed pairs of cam lobes which are positioned such that inward movement of the plungers 14 can only take place while the groove at the end of the passage 16 is in communication with an outlet. When the groove moves into register with an inlet passage 18, fuel is supplied to the bore 13 and the plungers 14 are moved outwardly, the extent of outward movement being limited by the abutment of the surfaces on the shoes with the flared surface defined by the enlarged portion 24 of the shaft. The axial setting of the distributor member therefore determines the amount by which the plungers 14 can move outwardly and thereby the amount of fuel which is delivered by the apparatus at each delivery stroke. In the example as the distributor member is moved towards the right the quantity of fuel which is delivered increases.

The pressure in the chamber 30 acts upon the distributor member to bias the distributor member against the action of the spring 29. An alternative arrangement is to allow the spring to act at the opposite end of the distributor member and to provide a piston slidable within the chamber which in the example, accommodates the spring 29.

The fluid under pressure in the chamber 30 is derived from the outlet of the supply pump 20 and the pressure is controlled by a governor of the "two-speed" type. In such a governor the idling speed and maximum speed are controlled by the governor while the amount of fuel supplied to the engine and hence its speed between idling and maximum speed is controlled by an operator adjustable control forming part of the governor.

Referring to FIG. 2 of the drawings there is shown an hydraulic circuit diagram which provides for "two-speed" governing. The chamber 30 communicates by way of a restricted orifice 33 with the outlet of the low pressure supply pump 20 which as previously stated, is accommodated within the space 21. In addition, the chamber 30 communicates with a drain by way of a first restricted orifice 34 and a second restricted orifice 35 connected in series. In parallel with the second 35 is a third restricted orifice 36. The orifices 34, 35 and 36 are variable as will be explained.

The third orifice 36 forms part of the idling governor and at speeds above idling, the orifice is closed. At idling speed the size of the orifice is varied to control the pressure within the chamber 30 and thereby the amount of fuel supplied to the engine. At idling speed the second orifice 35 will be closed for a reason which will be explained, and as a result there is no flow of fluid therethrough. Above idling speed as previously stated, the orifice 36 is closed and the control of the pressure in the chamber is effected by varying the size of the second orifice 35, it will be understood that the first orifice 34 is fully open. The purpose of the first orifice 34 is to control the maximum speed of the engine and as this is approached, the orifice 34 is closed so as to effect an increase in the pressure in the chamber 30 and thereby reduce the amount of fuel supplied to the engine. The third orifice 36 can if so desired be connected directly between the chamber 30 and the drain, that is to say in parallel with the first and second orifices 34,35.

Turning now to FIG. 1, a lever 37 is provided which transmits any movement of the distributor member 12 to a sleeve 38 in which is formed a port 39 which is in constant communication with a passage 40. The effective size of the port 39 is controlled by a rod member 41 which is spring loaded by means of a spring 42 so that an extended portion of the rod member can bear against an angularly adjustable cam 43. The cam 43 is connected to an operator adjustable member, such for example as the throttle pedal of a vehicle.

The apparatus also includes a cylinder 44 which has an enlarged portion 45 at one end and which at its other end is connected to the outlet of the low pressure supply pump 20. Within the enlarged portion 45 which communicates with a drain, is a coiled compression spring 46 which bears against an abutment plate 47 and this constitutes an abutment for one end of a further coiled compression spring 48, the other end of which bears against a spool 49. The spring 46 is preferably a preloaded spring.

The spool is provided with two spaced circumferential grooves 50, 51 which are interconnected by a passage formed in the spool and which extends to the end of the spool remote from the spring 48. Formed in the end portion of the aforesaid passage is the restrictor 33 and the groove 50 is in constant communication with the chamber 30.

The goove 51 communicates with a port 52 which communicates with the passage 40. The port 52 in conjunection with the groove 51 constitutes the first variable orifice 34. The passage 40 also communicates with a port 53 formed in the wall of the cylinder and which in conjunction with a further groove 54 formed in the spool, constitutes the third variable orifice 36. The groove 54 communicates by way of a passage formed in the spool with the portions of the cylinder which contain the springs.

The position of the parts shown in FIG. 1 corresponds to the situation which occurs when the operator has released the throttle pedal and the engine is slowing down. In this situation the pressure in the chamber 30 is at its maximum thereby reducing to a minimum the amount of fuel supplied to the engine. This is because the port 39 is closed as also is the port 53. As the engine speed falls so also does the pressure applied to the left hand end of the spool and gradually the port 53 will be uncovered to the groove 54 thereby causing a reduction in the pressure in the chamber 30 and hence an increase in the amount of fuel supplied to the engine. An equilibrium position is established and the idling speed controlled.

If the throttle pedal of the vehicle is depressed, then the port 39 will be uncovered thereby reducing the pressure in the chamber 30 and allowing the distributor member to be moved by the action of the spring 29 in a direction to increase the amount of fuel supplied to the engine. The sleeve 38 will move in the opposite direction and the port 39 will be partly covered by the rod 41. Thus the axial setting of the distributor member will correspond with the axial position of the rod 41.

As the engine accelerates from its idling speed, the spool 49 will move against the action of the spring 48 so that it contacts the abutment 46. In this position the port 53 is completely covered but the port 52 remains open to the groove 51. No movement of the spool will occur until the maximum engine speed is approached at which speed the spool starts to move against the action of the spring 46. In so doing, the port 52 starts to close and the pressure in the space 30 starts to increase thereby effecting a reduction in the amount of fuel supplied to the engine. Hence the spool 49 provides by way of the various ports and springs, control of the idling speed and also the maximum speed while the rod 41 in conjunction with the cam 43, provides for control of the fuel supplied at engine speeds between idling and maximum speed. There is one situation where the port 39 and rod 41 in effect act in opposition to the spool and port 52. This is where at part load, the maximum allowed engine speed is approached. At part load the port 39 will be partly open and as the engine speed increases, the port 52 will start to close and this will have the effect of increasing the pressure in the chamber 30 thereby to reduce the amount of fuel. As the distributor member moves to reduce the fuel, the sleeve 38 will move in the opposite direction thereby tending to increase the size of the port 39 but owing to the reduction in the size of the orifice 52 as explained above, it will have no effect on the pressure in the chamber 30.

The governor system as described can be used to control the fuel flow to an apparatus of the type in which the quantity of fuel supplied by the apparatus is controlled by throttling the fuel flow to the bore containing the pumping plunger or plungers. Such an apparatus is described in the specification of British Pat. No. 1,488,872. The apparatus as shown in this specification includes an angularly movable throttle valve and in applying the governor system as described, the throttle valve can be replaced by a flow control valve which is controlled by a spring loaded piston responsive to the pressure downstream of the restrictor 33. The mechanical governor is of course omitted.

A further modification is to omit the throttle valve and the mechanical governor and to supply fuel to the injection pump from downstream of the orifices 35, 36. In addition, the orifice 33 is omitted as also is the groove 50. Moreover, the sleeve 38 is no longer axially movable and can if so desired, be omitted, the port 39 being formed in the wall of the cylinder which contains the rod.

I claim:

1. A two speed governor for use with a fuel injection pumping apparatus for supplying fuel to an internal combustion engine comprising a source of fuel under pressure, means for controlling said pressure so that it varies in accordance with the speed at which in use the associated engine is driven, first and second variable orifices connected in series and through which fluid can flow from said source, manually operable means for controlling the degree of restriction offered by said second orifice, piston means responsive to the pressure of said source and acting to close said first orifice when the speed of the associated engine increases to its maximum value, and a third variable orifice connected in parallel with at least said second orifice, said piston means acting to close said third orifice when the speed of the associated engine is above its idling speed, the fuel flow through said orifices acting to control the amount of fuel supplied by the apparatus.

2. A governor according to claim 1 in which said piston means comprises a spool slidable within a cylinder, one end of said cylinder being connected to said source, and first and second resilient means disposed at the other end of the cylinder for exerting a force on said spool to oppose the force exerted on said spool by the fuel under pressure.

3. A governor according to claim 2 in which said first and third orifices are defined by ports respectively defined in said cylinder, said spool having grooves side faces of which act to control the degree of restriction provided by said ports.

4. A governor according to claim 3 in which the fuel flow through said orifices is supplied to the apparatus during the filling periods thereof.

5. A governor according to claim 3 including a fixed orifice interposed between said source and the first, second and third orifices, the sizes of said first, second and third orifices controlling the pressure downstream of said fixed orifice and a conduit through which the pressure downstream of said fixed orifice is applied to a movable regulating component of the apparatus whereby as the pressure downstream of said fixed orifice varies so does the amount of fuel supplied by the apparatus.

6. A governor according to claim 5 in which said second orifice and said manually operable means comprise a port formed in the wall of a cylinder, a rod member movable in the cylinder to control the effective size of said port and cam means operable to determine the axial setting of said rod within the cylinder.

7. A governor according to claim 6 in which said cylinder is defined by an axially movable sleeve, and linkage means connecting said sleeve with said movable regulating component whereby the position of said regulating component in the intermediate speed range depends upon the axial setting of said rod.

* * * * *